US011268671B2

(12) United States Patent
Zhu et al.

(10) Patent No.: US 11,268,671 B2
(45) Date of Patent: Mar. 8, 2022

(54) OPTICAL DEVICE FOR HEADLIGHT, AUTOMOTIVE LIGHTING DEVICE AND AUTOMOBILE

(71) Applicant: HASCO VISION TECHNOLOGY CO., LTD., Shanghai (CN)

(72) Inventors: He Zhu, Shanghai (CN); Zhiping Qiu, Shanghai (CN); Hui Li, Shanghai (CN); Cong Li, Shanghai (CN)

(73) Assignee: HASCO VISION TECHNOLOGY CO., LTD, Shanghai (CN)

( * ) Notice: Subject to any disclaimer, the term of this patent is extended or adjusted under 35 U.S.C. 154(b) by 0 days.

(21) Appl. No.: 17/042,343

(22) PCT Filed: Jul. 26, 2019

(86) PCT No.: PCT/CN2019/097932
§ 371 (c)(1),
(2) Date: Sep. 28, 2020

(87) PCT Pub. No.: WO2020/232826
PCT Pub. Date: Nov. 26, 2020

(65) Prior Publication Data

US 2021/0270439 A1 Sep. 2, 2021

(30) Foreign Application Priority Data

May 20, 2019 (CN) ..... 201910420690.9

(51) Int. Cl.
*F21S 41/33* (2018.01)
*F21S 41/62* (2018.01)
*F21W 102/18* (2018.01)

(52) U.S. Cl.
CPC ..... *F21S 41/335* (2018.01); *F21S 41/62* (2018.01); *F21W 2102/18* (2018.01)

(58) Field of Classification Search
CPC ..... F21S 41/141; F21S 41/143; F21S 41/151; F21S 41/26; F21S 41/335; F21S 41/62;
(Continued)

(56) References Cited

U.S. PATENT DOCUMENTS

2002/0191395 A1* 12/2002 Fleury ..... F21S 43/40 362/236
2008/0151567 A1* 6/2008 Albou ..... F21S 41/663 362/507

(Continued)

FOREIGN PATENT DOCUMENTS

CN 101435545 A 5/2009
CN 102679254 A 9/2012

(Continued)

*Primary Examiner* — Zheng Song
(74) *Attorney, Agent, or Firm* — Volpe Koenig

(57) ABSTRACT

An optical device for the headlight includes a left-hand drive optical element and a right-hand drive optical element. The left-hand drive optical element includes a left-hand drive light incident part and a left-hand drive transmission part which is arranged in the light emergent end region of the left-hand drive light incident part and extends in the light emergent direction; the light emergent end of the left-hand drive transmission part is provided with a left-hand drive cut-off part capable of forming a left-hand drive cut-off line. The right-hand drive optical element is similarly arranged. The disclosure further relates to the automotive lighting device including the optical device and the automobile including the automotive lighting device.

31 Claims, 11 Drawing Sheets

(58) Field of Classification Search
CPC ..... F21S 43/235; F21S 43/239; F21S 43/241; F21S 43/249; F21W 2102/18
See application file for complete search history.

(56) References Cited

U.S. PATENT DOCUMENTS

| | | | | |
|---|---|---|---|---|
| 2014/0016343 | A1* | 1/2014 | Brendle | F21S 41/365 362/518 |
| 2014/0321143 | A1* | 10/2014 | Hossfeld | F21S 41/321 362/516 |
| 2017/0130923 | A1 | 5/2017 | Nishimura et al. | |
| 2017/0276309 | A1* | 9/2017 | Nakazawa | F21S 41/24 |
| 2017/0276310 | A1* | 9/2017 | Nakazawa | B60Q 1/143 |
| 2019/0086050 | A1* | 3/2019 | Dikau | F21S 41/24 |
| 2019/0120457 | A1 | 4/2019 | Alisafaee et al. | |
| 2019/0154222 | A1* | 5/2019 | Iwasaki | F21S 41/148 |
| 2020/0263848 | A1* | 8/2020 | Gousset-Rousseau | F21S 41/285 |
| 2020/0292143 | A1* | 9/2020 | Spinger | G02B 27/09 |

FOREIGN PATENT DOCUMENTS

| | | | |
|---|---|---|---|
| CN | 202598352 | U | 12/2012 |
| CN | 102529796 | B | 10/2014 |
| CN | 204285338 | U | 4/2015 |
| CN | 105570794 | A | 5/2016 |
| CN | 206469173 | U | 9/2017 |
| CN | 105135317 | B | 6/2018 |
| CN | 108633296 | A | 10/2018 |
| CN | 110220158 | A | 9/2019 |
| JP | 2004186031 | A2 | 7/2004 |

* cited by examiner

OPTICAL DEVICE FOR HEADLIGHT, AUTOMOTIVE LIGHTING DEVICE AND AUTOMOBILE

CROSS REFERENCE TO RELATED APPLICATIONS

This application is a 35 USC §371 national stage of international application No. PCT/CN2019/097932, which is entitled "OPTICAL DEVICE FOR HEADLIGHT, AUTOMOTIVE LIGHTING DEVICE AND AUTOMOBILE, was filed Jul. 26, 2019, and claims priority to Chinese Application No. 201910420690.9, filed on May 20, 2019," both of which are incorporated herein by reference as if fully set forth.

FIELD

The present disclosure relates to the technical field of automotive lighting, in particular to an optical device for a headlight, an automotive lighting device and an automobile.

BACKGROUND

In the technical field of headlights, because of the difference between left-hand driving and right-hand driving, the regulatory requirements in different countries and regions are not consistent, and the difference is reflected in the low-beam cut-off line that the shape of the low-beam cut-off line of a left-hand drive automobile is low on the left side, while the shape of the low-beam cut-off line of a right-handed automobile is low on the right side. With the development of the automotive industry and the international economy, the internationalization of the automotive industry is increasing. As lighting devices for automobiles, headlights are indispensable and important parts of the automobiles at present and in the future. In order to meet the needs of the international market, automotive lighting devices need to meet the lighting needs in different countries and regions.

The prior art of automotive lighting devices integrated with left-hand driving and right-hand driving may refer to the Chinese patent for disclosure with the number being CN105135317B, which discloses a general-purpose LED headlight applicable to the left-hand drive automobiles and the right-handed drive automobiles, in order to meet the requirements of the left-hand drive automobiles and the right-handed automobiles, the technology adopts the following technical solutions: LED light sources, a reflector and a light-shielding mechanism are provided; the light-shielding mechanism includes a first light-shielding sheet for forming a left-hand low-beam light pattern, a second light-shielding sheet for forming a right-hand low-beam light pattern, a driving mechanism for driving the first light-shielding sheet and the second light-shielding sheet to overturn and form a high-beam light pattern, a switching mechanism for switching the usage state of the first light-shielding sheet and the second light-shielding sheet, corresponding mounting brackets and other parts. The light patterns are switched by overturning the first light-shielding sheet and the second light-shielding sheet in the opposite directions through the switching mechanism, and therefore two different low-beam light patterns are switched. The working principle of left-hand driving is as follows: the free end of a shift lever is moved upwards, so that the first light-shielding sheet turns upwards, the effect of light distribution of a headlight is achieved through the first light-shielding sheet, then the corresponding LED light sources are turned on, and light forms low beams of left-hand driving through light distribution of the first light-shielding sheet. The working principle of right-hand driving is as follows: the free end of the shift lever is pulled down, so that the first light-shielding sheet turns downwards, the second light-shielding sheet achieves the light distribution effect of the headlight, and light forms low beams of right-hand driving through light distribution of the second light-shielding sheet. Prior art comparison documents adopting similar technical means may also refer to the Chinese patents CN202598352 U and CN102529796 B. The above technical solutions have three defects that: (1) the first optical element forming the left-hand driving and right-hand driving light patterns is a reflector, the optical element generally causes 15% energy loss of light, and the system optical efficiency needs to be further improved; (2) the light patterns of the left-hand driving and right-hand driving are switched through light-shielding sheets and a series of matching driving devices, the structure is quite complex, and consequently, the corresponding lighting device is large in size and high in cost; and (3) during the switching of left-hand driving and right-hand driving, a series of structural overturning motions will cause a certain mechanism movement noise, and after a long time of overturning, mechanism abrasion is caused, and therefore the accuracy of irradiation light patterns is affected.

Due to the defects of the prior art in improving light efficiency, simplifying system configuration, reducing noise and the like, a new technical solution in the technical field is urgently required to solve these technical problems.

SUMMARY

In order to overcome the defects of the prior art, a basic technical problem to be solved by the present disclosure at first is to provide an optical device for a headlight, and the device has the function of forming a left-hand driving light pattern and a right-hand driving light pattern, and has the advantages of high optical efficiency, simple optical system configuration and no noise.

The present disclosure also provides an automotive lighting device including the optical device for the headlight and an automobile including the automotive lighting device.

In order to achieve the above objects, a first aspect of the present disclosure provides an optical device for a headlight, the optical device includes a left-hand drive optical element and a right-hand drive optical element; the left-hand drive optical element includes a left-hand drive light incident part, and a left-hand drive transmission part which is arranged in the light emergent end region of the left-hand drive light incident part and extends in the light emergent direction; the light emergent end of the left-hand drive transmission part is provided with a left-hand drive cut-off part capable of forming a left-hand drive cut-off line; the right-hand drive optical element includes a right-hand drive light incident part and a right-hand drive transmission part which is arranged in the light emergent end region of the right-hand drive light incident part and extends in the light emergent direction, and the light emergent end of the right-hand drive transmission part is provided with a right-hand drive cut-off part capable of forming a right-hand drive cut-off line.

Preferably, the left-hand drive light incident part and the right-hand drive light incident part each comprise a light source connection portion and a lampshade, each light source connection portion is a concave arc surface cavity, and each lampshade is a horn-shaped light condensing cup which is gradually enlarged from the end close to the corresponding light source to the end away from the corresponding light source.

Preferably, the left-hand drive cut-off part includes a left-hand drive cut-off part horizontal line section, a left-hand drive cut-off part turning point section and a left-hand drive cut-off part diagonal section, and the right-hand drive cut-off part includes a right-hand drive cut-off part horizontal line section, a right-hand drive cut-off part turning point section and a right-hand drive cut-off part diagonal section.

Preferably, the left-hand drive cut-off part horizontal line section and the right-hand drive cut-off part horizontal line section are of a horizontal concave structure.

Preferably, the left-hand drive light incident part and the left-hand drive transmission part are integrally formed and are of a transparent structure, the right-hand drive light incident part and the right-hand drive transmission part are integrally formed and are of a transparent structure, and the left-hand drive transmission part and the right-hand drive transmission part are independently arranged; and the thickness of the left-hand drive cut-off part and the right-hand drive cut-off part is greater than or equal to 0.5 mm.

Preferably, the left-hand drive transmission part and the right-hand drive transmission part are both of a hollow closed structure. The light emergent end of the left-hand drive light incident part is located in the hollow closed structure of the left-hand drive transmission part, and the light emergent end of the right-hand drive light incident part is located in the hollow closed structure of the right-hand drive transmission part.

Preferably, the left-hand drive light incident part and the left-hand drive transmission part are independently arranged, the right-hand drive light incident part and the right-hand drive transmission part are independently arranged, and the left-hand drive transmission part, the left-hand drive cut-off part, the right-hand drive transmission part and the right-hand drive cut-off part are integrally formed and are of a platy structure with the thickness being less than or equal to 2 mm, wherein the left-hand drive cut-off part diagonal section intersects with the right-hand drive cut-off part diagonal section, and the distance between the left-hand drive cut-off part turning point section and the right-hand drive cut-off part turning point section is less than or equal to 2 mm.

Preferably, the upper surfaces of the left-hand drive transmission part and the right-hand drive transmission part are provided with aluminum plating layers, and the reflectivity of the aluminum plating layers is greater than or equal to 0.8.

Preferably, the left-hand drive light incident part, the left-hand drive transmission part, the right-hand drive light incident part and the right-hand drive transmission part are integrally formed and are of a transparent structure, and the thickness of the left-hand drive cut-off part and the right-hand drive cut-off part is greater than or equal to 0.5 mm.

Preferably, the left-hand drive transmission part and the right-hand drive transmission part are both of a hollow closed structure, the light emergent end of the left-hand drive light incident part is located in the hollow closed structure of the left-hand drive transmission part, and the light emergent end of the right-hand drive light incident part is located in the hollow closed structure of the right-hand drive transmission part, and the joint between the left-hand drive transmission part and the right-hand drive transmission part forms a narrow-end-up wedge-shaped cavity with openings at the upper end and the lower end, wherein the left-hand drive cut-off part diagonal section, the left-hand drive cut-off part turning point section, the right-hand drive cut-off part diagonal section and the right-hand drive cut-off part turning point section are arranged at the light emergent end of the wedge-shaped cavity.

A second aspect of the present disclosure provides an automotive lighting device, the automotive lighting device includes a lens and the above-mentioned optical device for the headlight, the left-hand drive light incident part is provided with a left-hand drive light source correspondingly, and the right-hand drive light incident part is provided with a right-hand drive light source correspondingly.

Preferably, the left-hand drive light incident part is internally provided with the left-hand drive light source, and the right-hand drive light incident part is internally provided with the right-hand drive light source.

Preferably, the left-hand drive light source and the right-hand drive light source are independently arranged and are individually addressable so as to be independently turned on and off.

Preferably, the left-hand drive light source and the right-hand drive light source are each composed of one or more LED light sources or laser light sources.

Preferably, the left-hand drive cut-off part and the right-hand drive cut-off part are located in the focal region of the lens.

A third aspect of the present disclosure provides an automobile including the above-mentioned automotive lighting device.

Through the above technical solutions, the present disclosure has the beneficial effects that:

1. The optical device of the present disclosure has high optical efficiency. On the one hand, the left-hand drive light pattern and the right-hand drive light pattern are switched by independently turning on or off the light sources in the left-hand drive light incident part and the right-hand drive light incident part, and in a specific light pattern situation, the light source corresponding to the unnecessary light pattern part is turned off, so that the light source utilization efficiency is improved; on the other hand, the corresponding light patterns are formed by turning on the light source in the left-light drive light incident part or the light source in the right-hand drive light incident part, instead of being formed by shielding the light patterns emitted by the light sources through a light-shielding structure, so that the optical efficiency is higher; and finally, since the left-hand drive optical element and the right-hand drive optical element are each provided with the light incident part and the transmission part, so that more light emitted by the light sources is collected and collimated by the light incident parts, after the light is transmitted in the transmission parts, the headlight patterns with cut-off lines are formed due to the cutting-off effect of the cut-off parts, and thus the light utilization efficiency is higher;

2. An optical system of the optical device for the headlight of the present disclosure is simple in structure, the left-light drive optical element and the right-hand drive optical element of the device are each provided with the light incident part, the transmission part and the cut-off part for forming the left-hand drive light pattern and the right-hand drive light pattern, the structure is relatively simple, and complicated structures such as a light-shielding sheet, a rotating mechanism and a solenoid valve are not required, so that the optical system is simple and easy to install; and 3. The left-hand drive light pattern and the right-hand drive light pattern are switched by independently turning on or off the light sources in the left-hand drive light incident part and the right-hand drive light incident part of the optical device for the headlight of the present disclosure, mechanism noise of the rotating mechanism and the solenoid valve is avoided, and noiseless switching can be achieved.

Other characteristics and advantages of the present disclosure will be described in detail in the following embodiments.

BRIEF DESCRIPTION OF THE DRAWINGS

The following drawings are used to provide a further understanding of the present disclosure, constitute a part of the specification and are used to explain the present disclosure together with the following embodiments, but the scope of protection of the present disclosure is not limited to the following drawings and embodiments. In the drawings.

Figure 1:
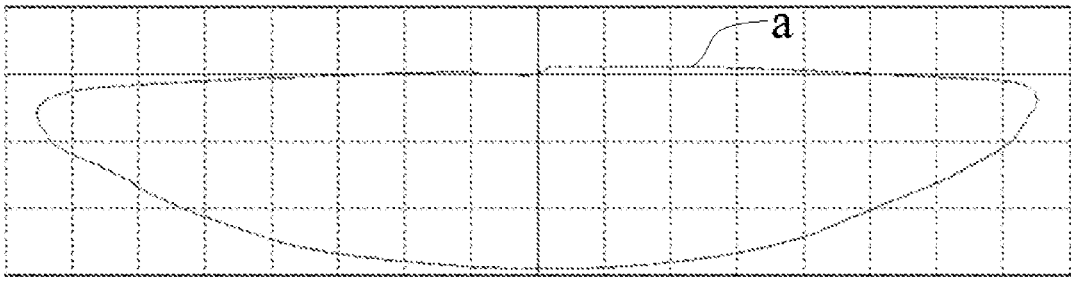
FIG. 1 is a schematic diagram of a left-hand drive low-beam light pattern.

Brief Description of the Symbols:

| | |
|---|---|
| 1 | Left-hand drive optical element, |
| 101 | Left-hand drive light incident part, |
| 102 | Left-hand drive transmission part, |
| 103 | Left-hand drive cut-off part, |
| 1031 | Left-hand drive cut-off part horizontal line section, |
| 1032 | Left-hand drive cut-off part turning point section |
| 1033 | Left-hand drive cut-off diagonal section, |
| 2 | Right-hand drive optical element, |
| 201 | Right-hand drive light incident part, |
| 202 | Right-hand drive transmission part, |
| 203 | Right-hand drive cut-off part, |
| 2031 | Right-hand drive cut-off part horizontal line section, |
| 2032 | Right-hand drive cut-off part turning point section, |
| 2033 | Right-hand drive cut-off part diagonal section, |
| 3 | Wedge-shaped cavity, |
| 4 | Right-hand drive light source, |
| 5 | light source connection portion, |
| 6 | lampshade, |
| a | Left-hand drive cut-off line, |
| b | Right-hand drive cut-off line, |
| c | Light pattern of the left-hand drive low-beam cut-off part, |
| d | Light pattern of the right-hand drive low-beam cut-off part. |

DETAILED DESCRIPTION OF THE EMBODIMENTS

The embodiments of the present disclosure are described in detail below with reference to the accompanying drawings. It should be understood that the embodiments described herein are only used to illustrate and explain the present disclosure, and the protection scope of the present disclosure is not limited to the embodiments described below.

In the description of the present disclosure, it should be explained that the orientations or positional relationships indicated by the terms "up", "down", "front" and "rear" are based on the orientations or positional relationships shown in the drawings, and are only for the convenience of describing the present disclosure and simplifying the description, rather than indicating or implying that a referred device or element must have a particular orientation, be constructed and operated in a particular orientation, and therefore cannot be understood as a limitation on the present disclosure. In the present disclosure, terms such as "light incident part", "transmitting part" and "cut-off part" used for technical feature description can better define and explain the corresponding technical features than the structural feature description, are more concise and clearer than the structural feature description, and can be determined by those skilled in the art without doubt.

Figure 2:
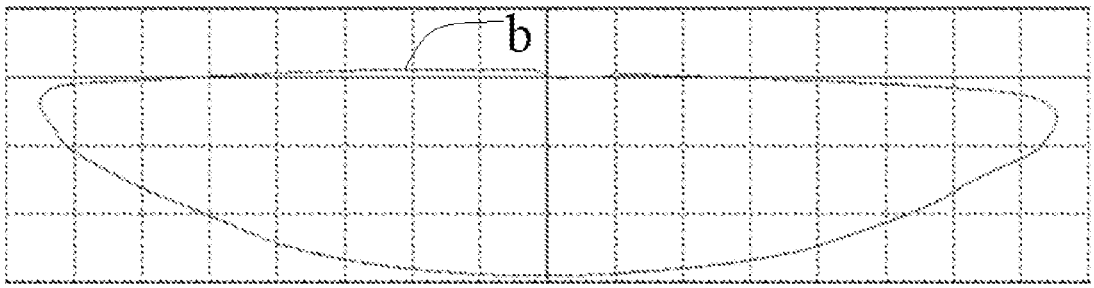
FIG. 2 is a schematic diagram of a right-hand drive low-beam light pattern.
Figure 3:
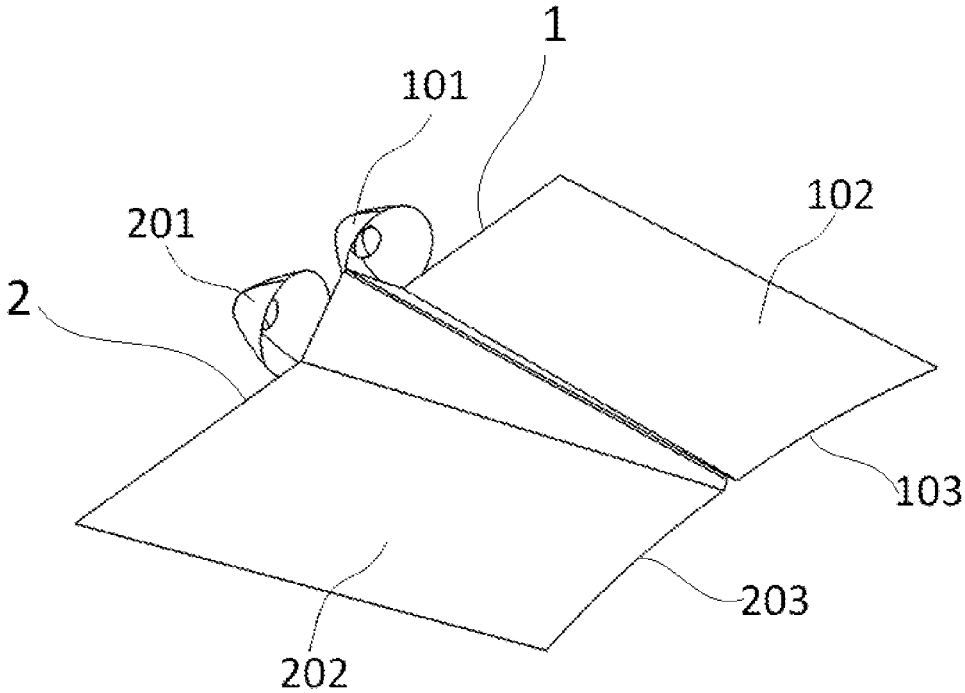
FIG. 3 is a schematic structural diagram of a specific embodiment of the optical device for the headlight according to the present disclosure, wherein the left-hand drive light incident part, the left-hand drive transmission part, the right-hand drive light incident part and the right-hand drive transmission part are separately arranged.
Figure 4:
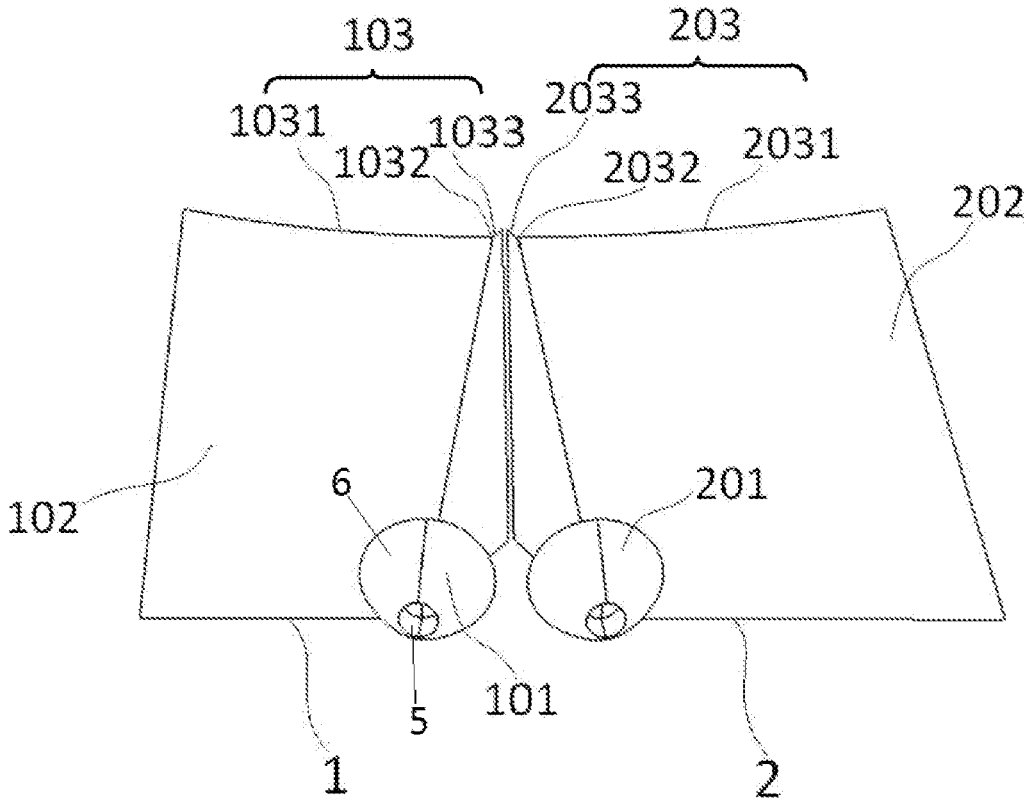
FIG. 4 is a top view of the optical device for the headlight shown in FIG. 3.
Figure 5:
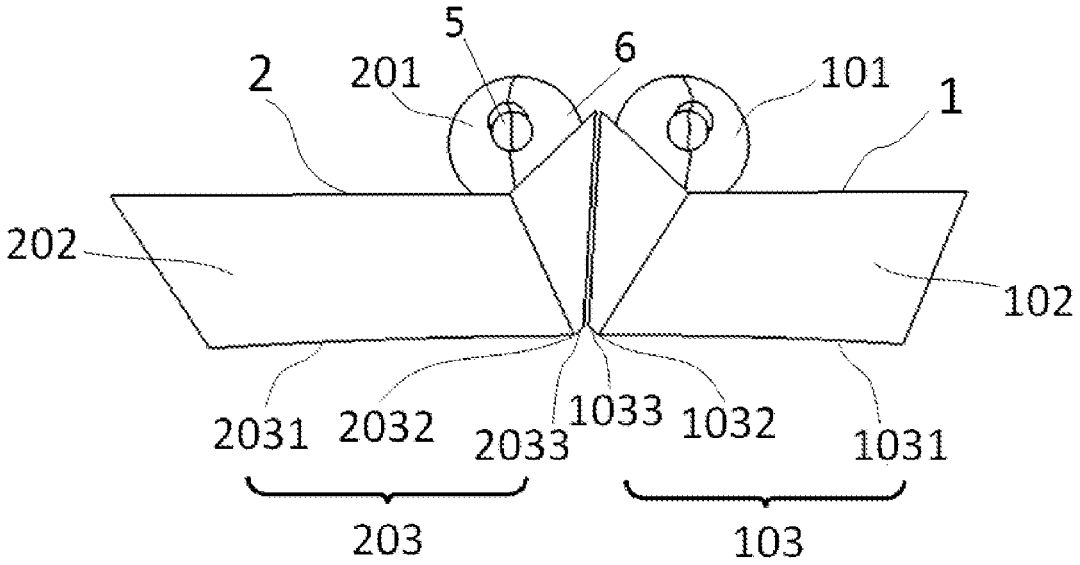
FIG. 5 is a front view of the optical device for the headlight shown in FIG. 3.
Figure 6:
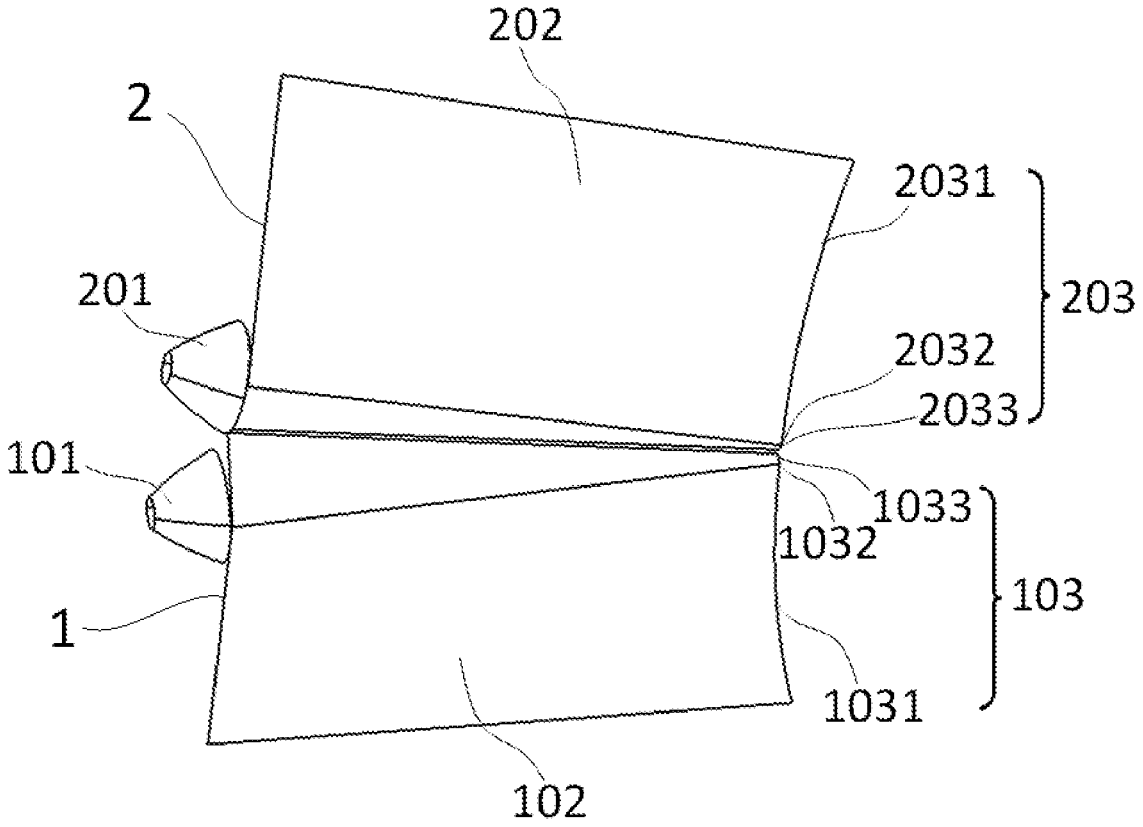
FIG. 6 is a bottom view of the optical device for the headlight shown in FIG. 3.
Figure 7:
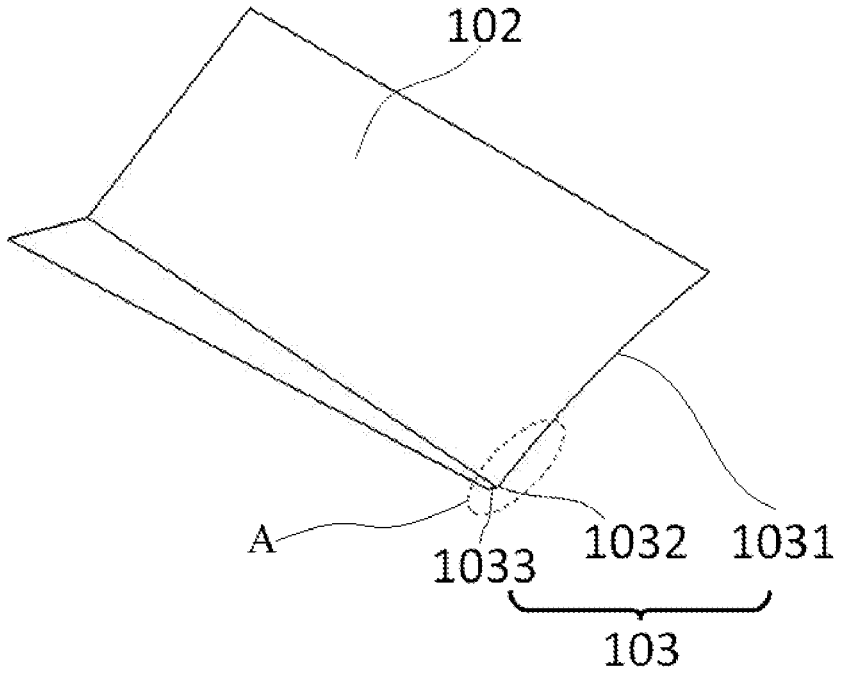
FIG. 7 is a schematic structural diagram of the left-hand drive transmission part and the left-hand drive cut-off part of the optical device for the headlight shown in FIG. 3.
Figure 8:
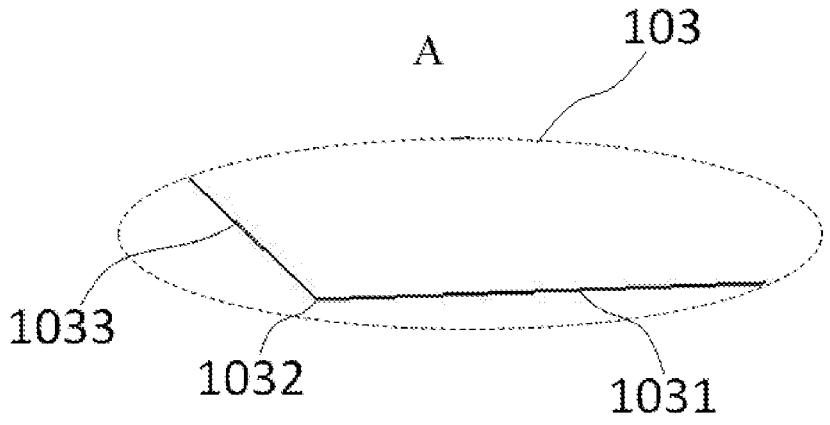
FIG. 8 is a partial enlarged view of the portion A in FIG. 7.
Figure 9:
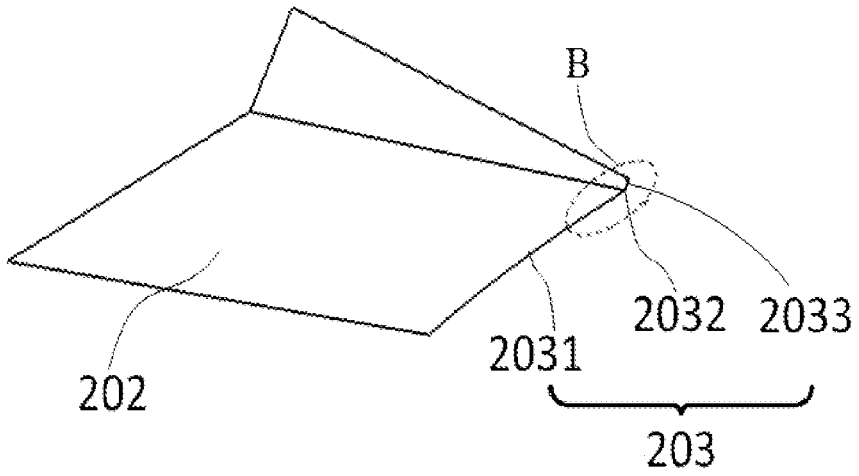
FIG. 9 is a schematic structural diagram of the right-hand drive transmission part and the right-hand drive cut-off part of the optical device for the headlight shown in FIG. 3.
Figure 10:
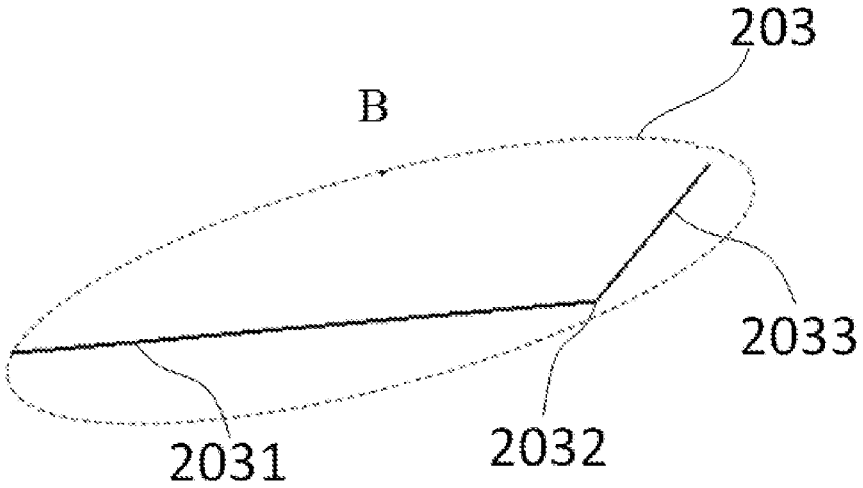
FIG. 10 is a partial enlarged view of the portion B in FIG. 9.
Figure 11:
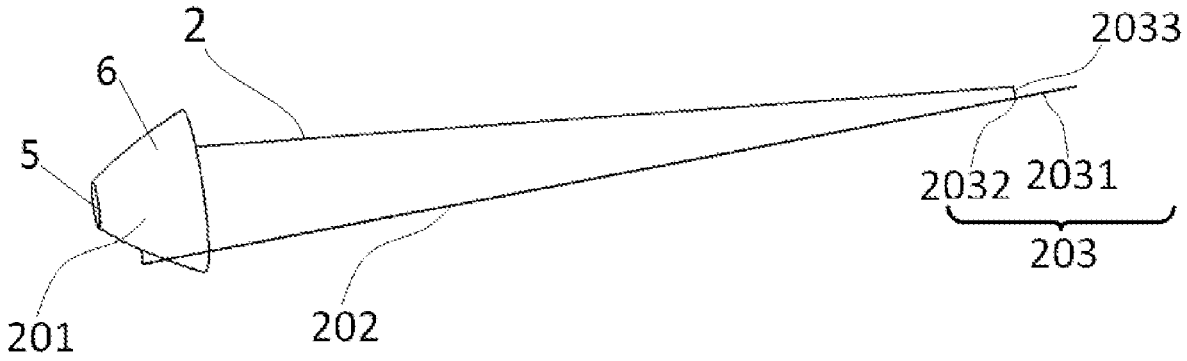
FIG. 11 is a schematic structural diagram of the right-hand drive optical element of the optical device for the headlight shown in FIG. 3.
Figure 12:
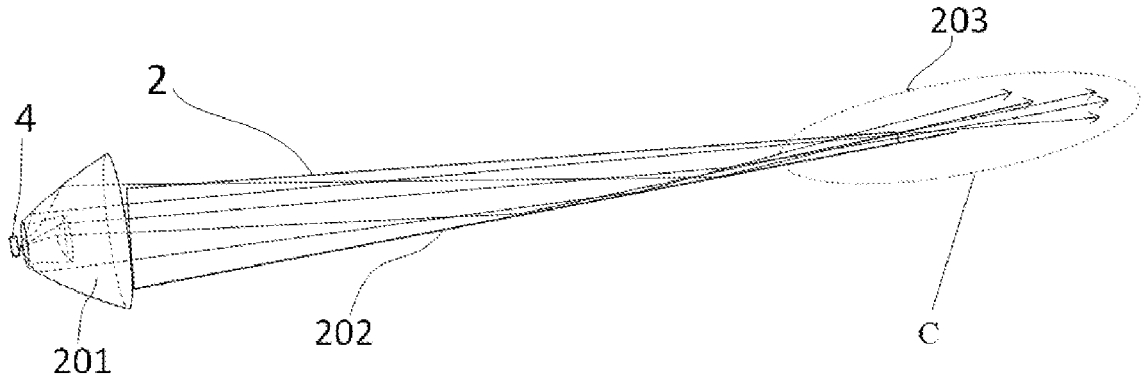
FIG. 12 is a schematic diagram of the light direction of the right-hand drive optical element shown in FIG. 11.
Figure 13:
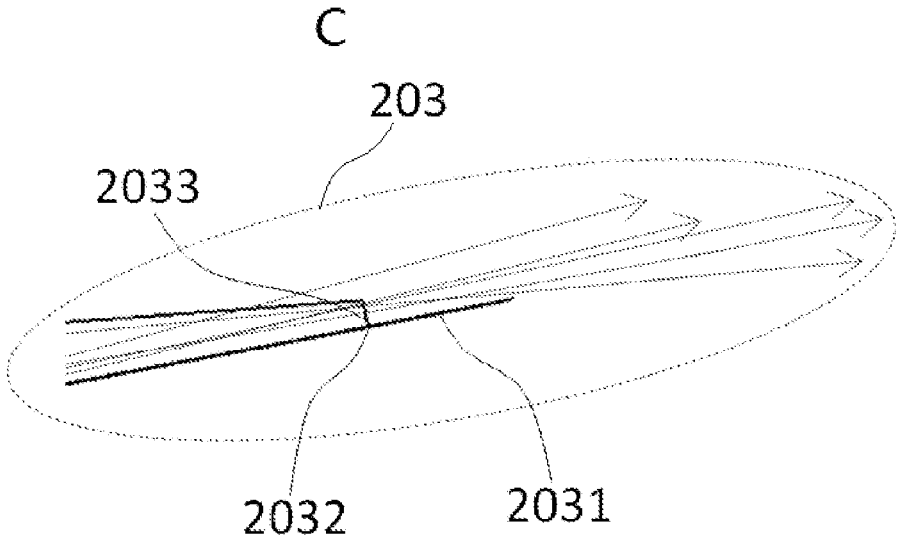
FIG. 13 is a partial enlarged view of the portion C in FIG. 12.

In the description of the present disclosure, it should be noted that the light emergent end or light emergent direction refers to the light emergent end or light emergent direction of the main light transmission direction. The "cut-off line" is a general term in the art. The cut-off line is a light pattern upper boundary with left-right vertical difference and a turning point at the V-axis position, and the diagonal line is connected to the upper boundary upwards via the turning point. FIG. 1 shows a low-beam light pattern of a headlight of a left-hand drive automobile. The upper boundary is the cut-off line. Referring to FIG. 1, the right side of the left-hand drive cut-off line a is higher than the left side of the left-hand drive cut-off line a in the up-down direction, the reason is that for the left-hand drive automobile, the light pattern on the right side illuminates a lane on the road and the right side of the lane, and the light pattern is high, then it will be brighter and farther on the road, while the light pattern on the left side is low, the boundary line of the light pattern on the left side is generally located at −0.57 degree according to the regulations, correspondingly illuminates the left side of the lane on the road, and mostly illuminates oncoming automobiles correspondingly, and the illumination brightness is low and the distance is short compared with the right side on application; and FIG. 2 shows a low-beam light pattern of a headlight of a right-hand drive automobile, it can be seen that compared to the left-hand drive cut-off line a, the right-hand drive cut-off line b is opposite in shape and is higher on the left side in the up-down direction.

The optical device for the headlight provided by the first aspect of the present disclosure, as shown in FIGS. 3 to 13, includes a left-hand drive optical element 1 and a right-hand drive optical element 2; the left-hand drive optical element 1 includes a left-hand drive light incident part 101, and a left-hand drive transmission part 102 which is arranged in the light emergent end region of the left-hand drive light incident part 101 and extends in the light emergent direction; the light emergent end of the left-hand drive transmission part 102 is provided with a left-hand drive cut-off part 103 capable of forming a left-hand drive cut-off line; the right-hand drive optical element 2 includes a right-hand drive light incident part 201 and a right-hand drive transmission part 202 which is arranged in the light emergent end region of the right-hand drive light incident part 201 and extends in the light emergent direction, and the light emergent end of the right-hand drive transmission part 202 is provided with a right-hand drive cut-off part 203 capable of forming a right-hand drive cut-off line.

It should be noted that, in the present disclosure, the left-hand drive light incident part 101, the left-hand drive transmission part 102, the left-hand drive cut-off part 103, the right-hand drive light incident part 201, the right-hand drive transmission part 202 and the right-hand drive cut-off part 203 may be separately-arranged components and then fixed after being assembled, or two or more of the components may be integrally formed and fixed with other components after being assembled. According to the optical device for the headlight of the basic technical solution of the present disclosure, during usage, the left-hand drive light incident part 101 and the right-hand drive light incident part 201 are internally provided with independent light sources, when the light source in the left-hand drive light incident part 101 is turned on, light emitted by the light source is collected and collimated by the left-hand drive light incident part 101, then the light emitted from the left-hand drive light incident part 101 is collected to the left-hand drive cut-off part 103 in the front-back extension direction of the left-hand drive transmission part 102, and the light is emitted after being cut off by the left-hand drive cut-off part 103 to form a left-hand drive light pattern; when the light source in the right-hand drive light incident part 201 is turned on, light emitted by the light source is collected and collimated by the right-hand drive light incident part 201, then the light emitted from the right-hand drive light incident part 201 is collected to the right-hand drive cut-off part 203 in the front-back extension direction of the right-hand drive transmission part 202, and the light is emitted after being cut off by the right-hand drive cut-off part 203 to form a right-hand drive light pattern; the light sources of the left-hand drive light incident part 101 and the right-hand drive light incident part 201 are independently arranged and individually addressable, and are independently turned on and off. When the light source in the left-hand drive light incident part 101 is turned on while the light source in the right-hand drive light incident part 201 is turned off, a headlight pattern corresponding to a left-hand drive automobile is formed, and when the light source in the right-hand drive light incident part 201 is turned on while the light source in the left-hand drive light incident part 101 is turned off, a headlight pattern corresponding to a right-hand drive automobile is formed.

It should be noted that "light is collected and collimated" refers to the process in which light emitted by the light sources in the light incident parts enters a structure at first, and the light is refracted into the light incident parts and irradiated toward the cut-off parts after being reflected by outer contours. "light is collected to the cut-off parts" means that the light entering from the light incident parts is gathered and emitted to the cut-off parts directly through the transmission parts or after being reflected by the transmission parts, and the positions of the cut-off parts are equivalent to light emergent surfaces of the optical elements, and light patterns in a cut-off shape are formed after cutting-off.

In a preferred embodiment of the present disclosure, the left-hand drive light incident part 101 and the right-hand drive light incident part 201 each comprise a light source connection portion and a lampshade. Preferably, each light source connection portion is a concave arc surface cavity, and each lampshade is a horn-shaped light condensing cup which is gradually enlarged from the end close to the corresponding light source to the end away from the corresponding light source. During usage, the light sources are arranged at the corresponding positions in the spaces defined by the concave arc surface cavities, and the lampshades can effectively collect and collimate the light emitted by the corresponding light sources, the light sources are better used, and the light utilization efficiency is improved.

In an embodiment of the present disclosure, as shown in FIGS. 3 to 11, the left-hand drive cut-off part 103 includes a left-hand drive cut-off part horizontal line section 1031, a left-hand drive cut-off part turning point section 1032 and a left-hand drive cut-off part diagonal section 1033. The right-hand drive cut-off part 203 includes a right-hand drive cut-off part horizontal line section 2031, a right-hand drive cut-off part turning point section 2032 and a right-hand drive cut-off part diagonal section 2033. The light pattern cut off by the left-hand drive cut-off part 103 is in the shape of a left-hand drive cut-off line due to the left-hand drive cut-off part horizontal line section 1031, the left-hand drive cut-off part turning point section 1032 and the left-hand drive cut-off part diagonal section 1033. The light pattern cut off by the right-hand drive cut-off part 203 is in the shape of a right-hand drive cut-off line due to the right-hand drive cut-off part horizontal line section 2031, the right-hand drive cut-off part turning point section 2032 and the right-hand drive cut-off part diagonal section 2033.

It should be noted that the horizontal line section, the turning point section and the diagonal section of the left-hand drive cut-off part 103 or the right-hand drive cut-off part 203 are in a corresponding cut-off line shape, so that the light pattern formed after cutting-off is in the shape of the corresponding cut-off line. However, the shape of the lower surfaces of the optical elements is not limited, and the lower surfaces may be two bent surfaces which are in surface connection, or special-shaped curved surfaces, as long as the shape of the corresponding cut-off line is formed at the cut-off part. "Horizontal" should be understood as an extending trend in the left-right direction, that is, the line segment is horizontal or approximately horizontal from front to back, and is limited to a strict horizontal relationship.

In a preferred embodiment of the present disclosure, the left-hand drive cut-off part horizontal line section 1031 and the right-hand drive cut-off part horizontal line section 2031 are of a horizontal concave structure. When the left-hand drive optical element 1 or the right-hand drive optical element 2 is cooperatively used with a lens, the focal point of the lens is not a line or a surface, and the cut-off part is used as a light emergent portion of the optical element. The aberration of light beams on the two sides can be corrected through the horizontal concave structures, and a clearer headlight pattern is formed. "Concave" here means that the distance between the position close to the middle and the lens is greater than the distance between the two sides and the lens, the concave line type is not strictly limited herein, the line may be specifically set as a inwardly-concave arc line or a line in a similar shape, for example, an irregular curve. The equivalent technical effects can be achieved as long as the left-hand drive cut-off part horizontal line section 1031 and the right-hand drive cut-off part horizontal line section 2031 are in a concave linear shape in the plan view from top to bottom. Specifically, the left-hand drive cut-off part horizontal line section 1031 and the right-hand drive cut-off part horizontal line section 2031 may be arranged as an inwardly-concave arc structure with the radius R being greater than or equal to 80 mm.

In a preferred embodiment of the present disclosure, as shown in FIGS. 14 to 17, the left-hand drive light incident part 101 and the left-hand drive transmission part 102 are integrally formed and are of a transparent structure. The right-hand drive light incident part 201 and the right-hand drive transmission part 202 are integrally formed and are of a transparent structure. The left-hand drive transmission part 102 and the right-hand drive transmission part 202 are independently arranged; the thickness of the left-hand drive cut-off part 103 and the right-hand drive cut-off part 203 is greater than or equal to 0.5 mm, the structure stability between the light incident parts and the transmission parts is improved, meanwhile, the light collected and collimated by the light incident parts is completely reflected and transmitted in the transmission parts through the transparent structures, and the light loss is small compared with optical elements of other structures. Since the up-down angle of the left-hand drive headlight pattern cut-off part or right-hand drive headlight pattern cut-off part is about 0.57 degree, in combination with the requirements of the manufacturing process, the thickness of the corresponding optical element cannot be too small, and the thickness less than 0.5 mm is difficult to guarantee in terms of manufacturing accuracy. Therefore, the thickness of the left-hand drive cut-off part 103 and the right-hand drive cut-off part 203 is set to greater than or equal to 0.5 mm, thus, the accuracy requirements of the manufacturing process can be met, the angle of the light pattern cut-off parts can greater than 0.57 degree, and the whole low-beam light pattern requirement is met after the light pattern is superimposed with a low-beam stretched-out light pattern, wherein the low-beam stretched-out light pattern refers to a light pattern of the low-beam light pattern other than the cut-off part light pattern.

Figure 14:
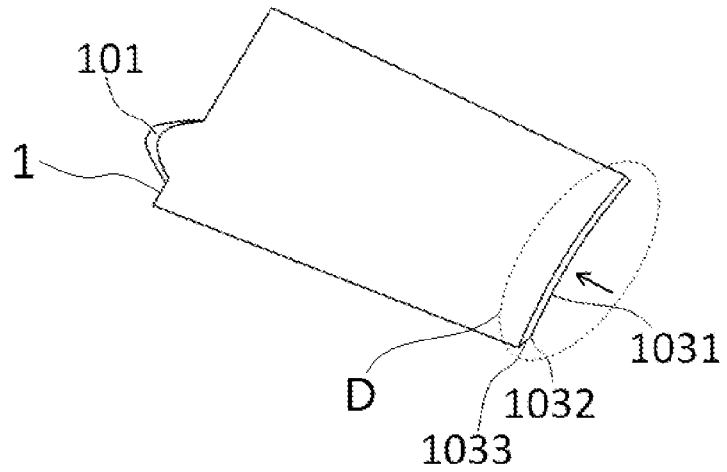
FIG. 14 is a schematic structural diagram of a specific embodiment of the left-hand drive optical element according to the present disclosure, wherein the left-hand drive light incident part and the left-hand drive transmission part are integrally formed.
Figure 15:
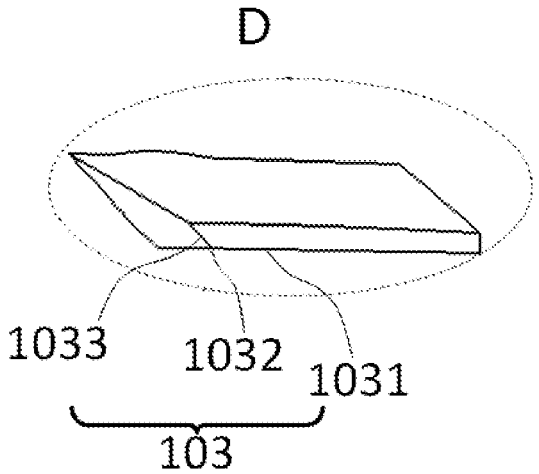
FIG. 15 is a partial enlarged view of the portion D in FIG. 14.
Figure 16:
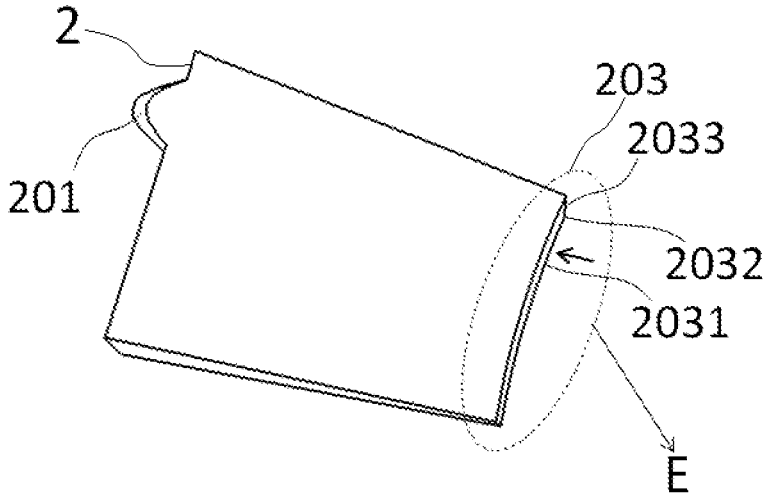
FIG. 16 is a schematic structural diagram of a specific embodiment of the right-hand drive optical element according to the present disclosure, wherein the right-hand drive light incident part and the right-hand drive transmission part are integrally formed.
Figure 17:
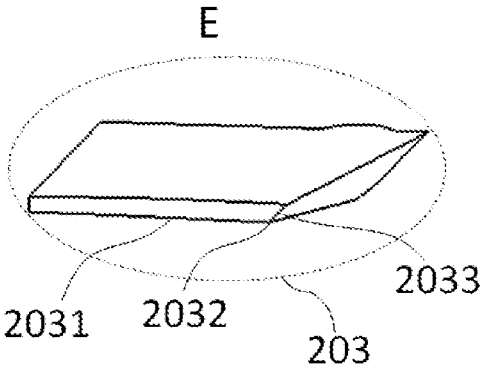
FIG. 17 is a partial enlarged view of the portion E in FIG. 16.
Figure 18:
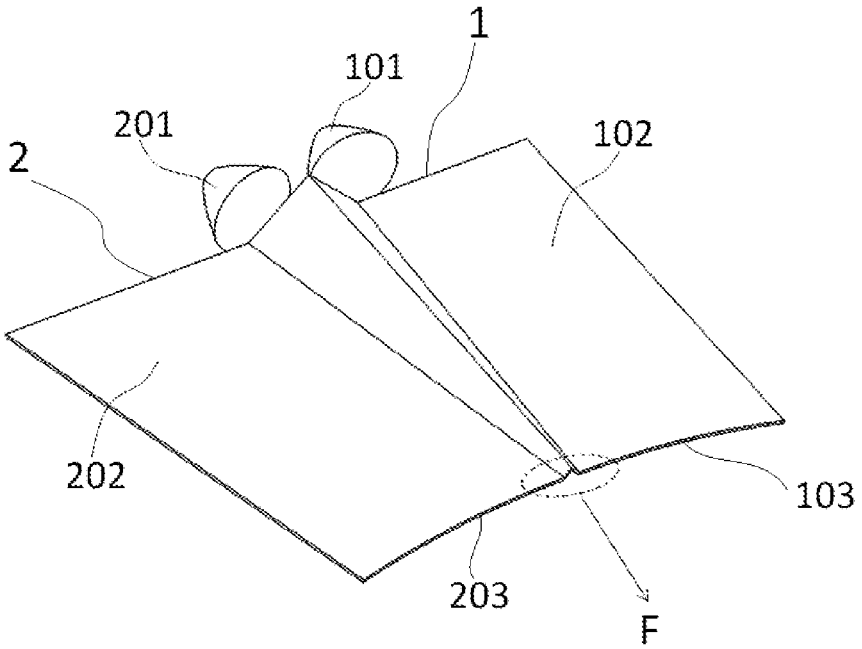
FIG. 18 is a schematic structural diagram of another specific embodiment of the optical device for the headlight according to the present disclosure, wherein the left-hand drive transmission part and the right-hand drive transmission part are integrally formed.
Figure 19:
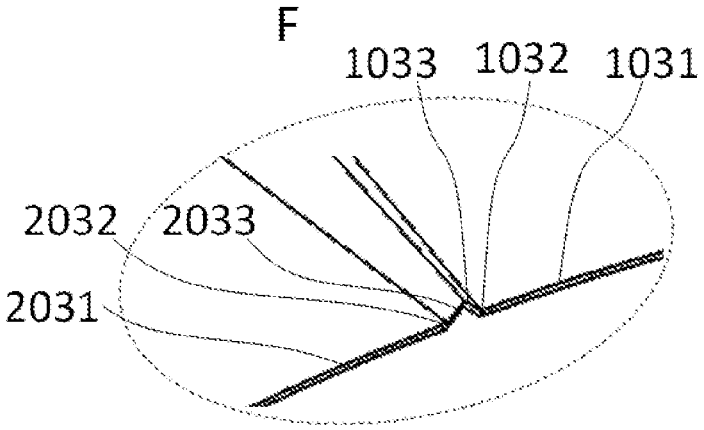
FIG. 19 is a partial enlarged view of the portion F in FIG. 18.
Figure 20:
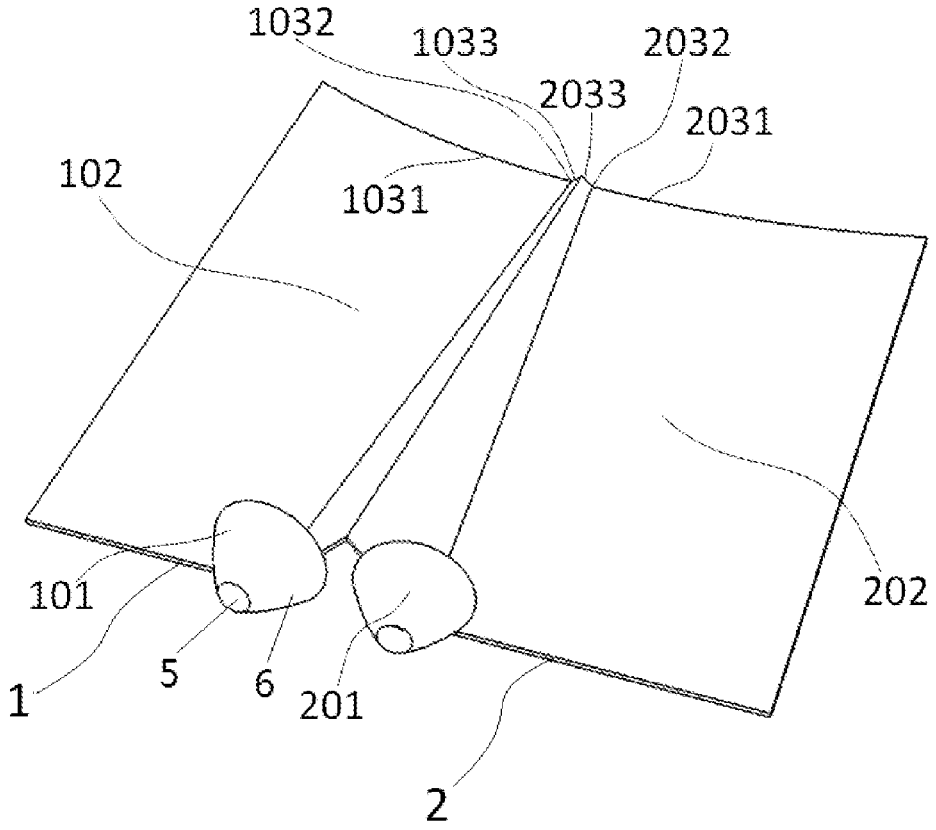
FIG. 20 is a top view of the optical device for the headlight shown in FIG. 18.
Figure 21:
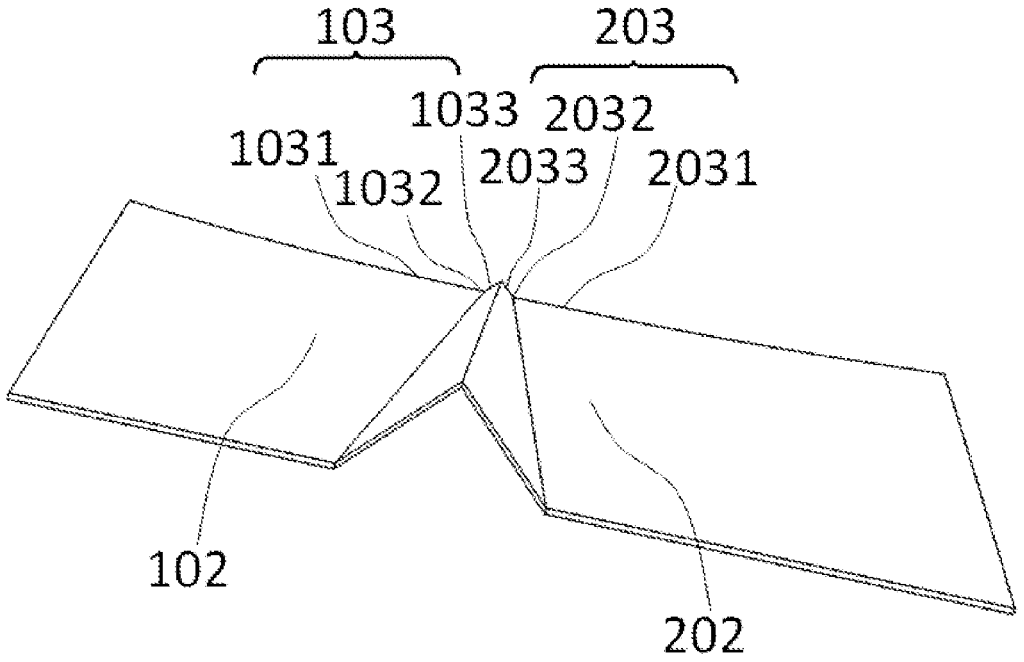
FIG. 21 is a schematic structural diagram of the left-hand drive transmission part and the right-hand drive transmission part of the optical device for the headlight shown in FIG. 18.
Figure 22:
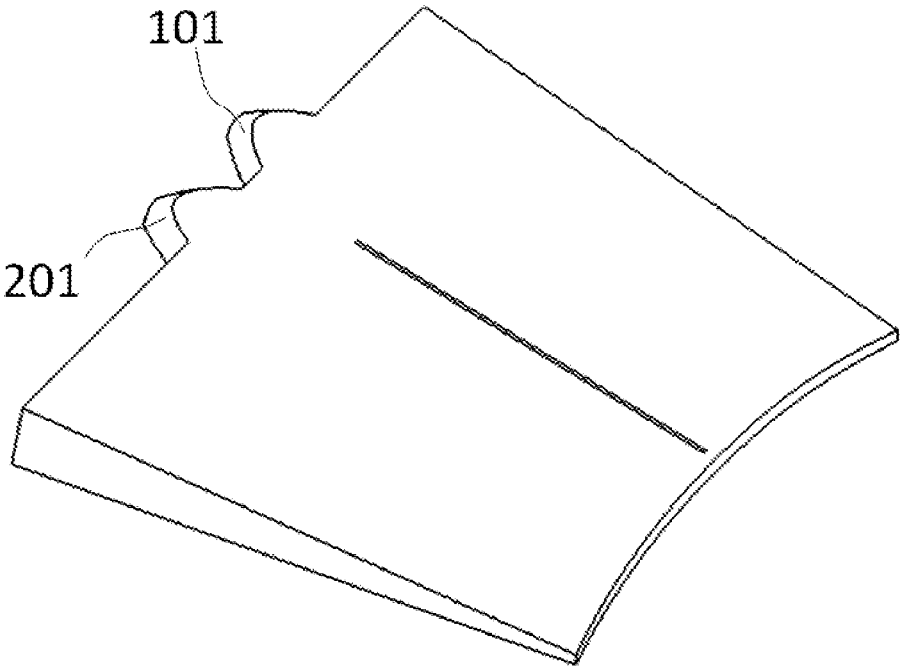
FIG. 22 is a schematic structural diagram of a third specific embodiment of the optical device for the headlight according to the present disclosure, wherein the left-hand drive light incident part, the left-hand drive transmission part, the right-hand drive light incident portion and the right-hand drive transmission portion are integrally formed.
Figure 23:
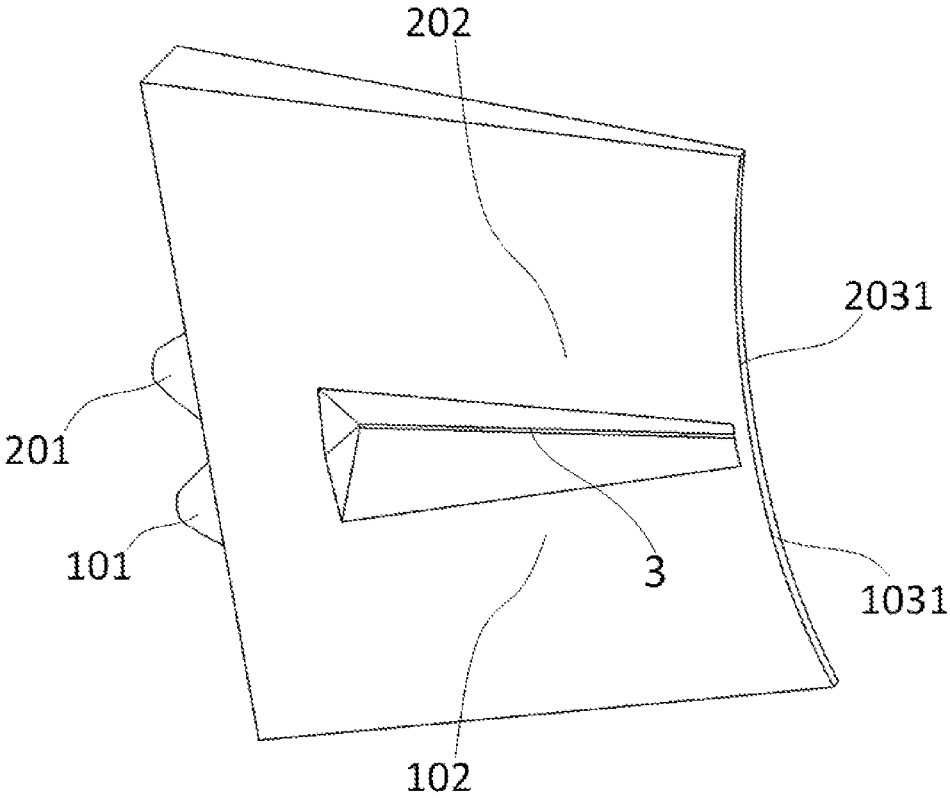
FIG. 23 is a first bottom view of the optical device for the headlight shown in FIG. 22.
Figure 24:
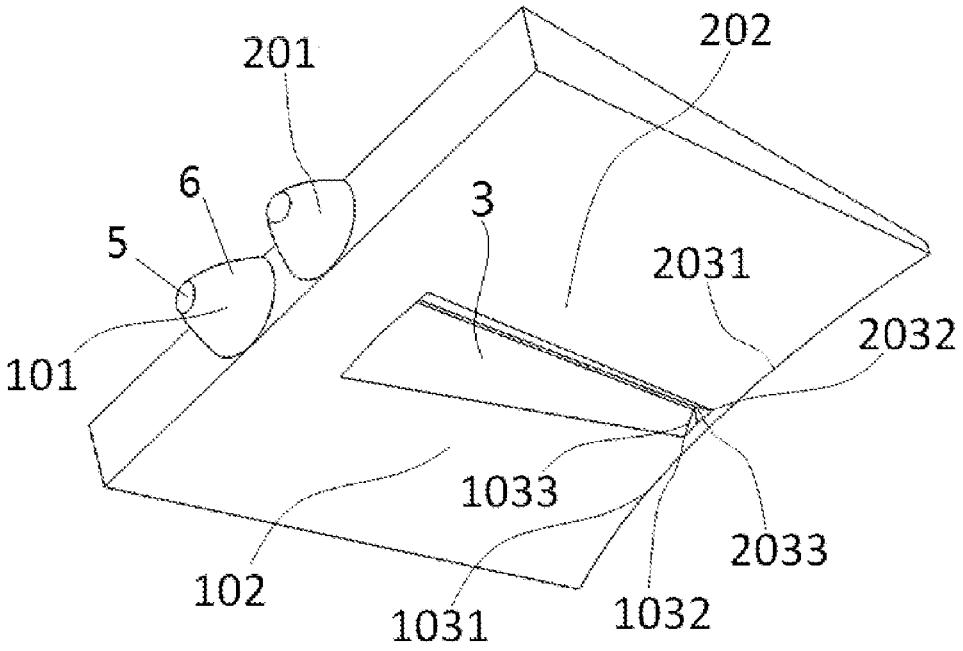
FIG. 24 is a second bottom view of the optical device for the headlight shown in FIG. 22.
Figure 25:
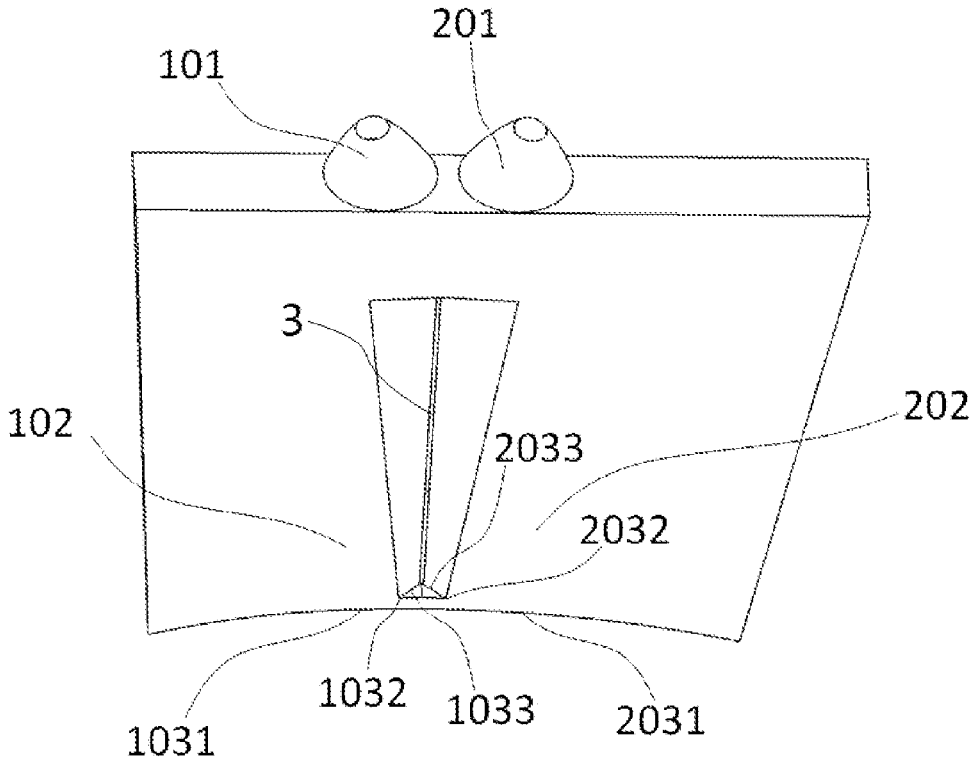
FIG. 25 is a third bottom view of the optical device for the headlight shown in FIG. 22.
Figure 26:
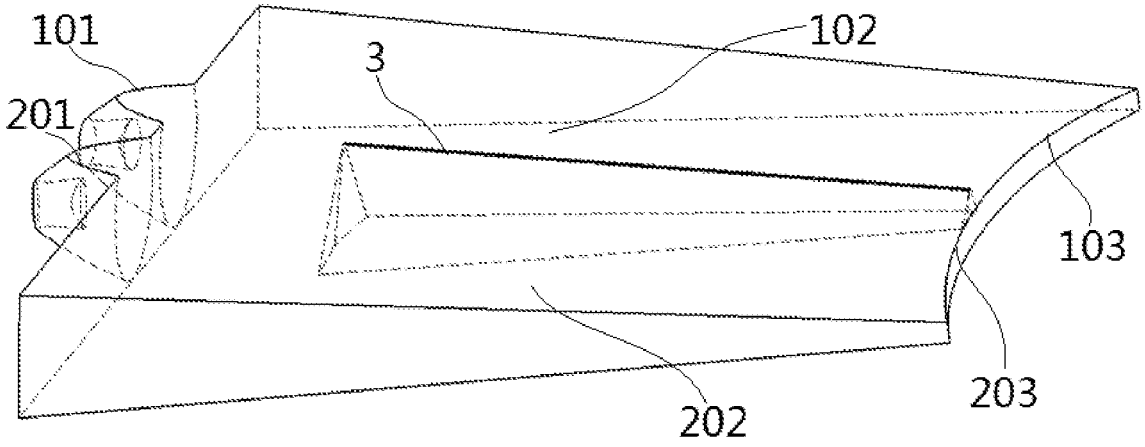
FIG. 26 is a side view of the optical device for the headlight shown in FIG. 22.

As shown in FIG. 14 and FIG. 16, the left-hand drive transmission part 102 and the right-hand drive transmission part 202 are both of a hollow closed structure. The light emergent end of the left-hand drive light incident part 101 is located in the hollow closed structure of the left-hand drive transmission part 102, and the light emergent end of the right-hand drive light incident part 201 is located in the hollow closed structure of the right-hand drive transmission part 202. The structure has the advantage that the left-hand drive light pattern optical element and the right-hand drive light pattern optical element are separately arranged, meanwhile, light output from the left-hand drive light incident part 101 or the right-hand drive light incident part 201 can be transmitted in the closed transmission part, and the optical efficiency is improved more advantageously.

In a preferred embodiment of the present disclosure, as shown in FIGS. 18 to 21, the left-hand drive light incident part 101 and the left-hand drive transmission part 102 are independently arranged, the right-hand drive light incident part 201 and the right-hand drive transmission part 202 are independently arranged, and the left-hand drive transmission part 102, the left-hand drive cut-off part 103, the right-hand drive transmission part 202 and the right-hand drive cut-off part 203 are integrally formed and are of a platy structure with the thickness being less than or equal to 2 mm, wherein the left-hand drive cut-off part diagonal section 1033 intersects with the right-hand drive cut-off part diagonal section 2033, and the distance between the left-hand drive cut-off part turning point section 1032 and the right-hand drive cut-off part turning point section 2032 is less than or equal to 2 mm. According to the structure, the left-hand drive transmission part 102, the left-hand drive cut-off part 103, the right-hand drive transmission part 202 and the right-hand drive cut-off part 203 are integrally formed, a worker just needs to fixedly connect the integrally formed structure with the left-hand drive light incident part 101 and the right-hand drive light incident part 201 when an optical device is assembled, and thus the whole optical device is convenient to mount and high in structure stability. Based on the manufacturing process, the weight of the optical elements and the production cost, the left-hand drive transmission part 102, the left-hand drive cut-off part 103, the right-hand drive transmission part 202 and the right-hand drive cut-off part 203 are arranged as a platy structure with the thickness being less than or equal to 2 mm, specifically, a thin plate structure with the thickness being 0.5 mm can be arranged, the accuracy requirements of the manufacturing process can be met, the influence of the weight of the optical elements on the light patterns can be further reduced, and the production cost is reduced as well.

Further, the upper surfaces of the left-hand drive transmission part 102 and the right-hand drive transmission part 202 are provided with aluminum plating layers, and the reflectivity of the aluminum plating layers is greater than or equal to 0.8, so that the surfaces of the transmission parts have a high light reflection effect, light collection and condensation of the transmission parts are enhanced, and the optical efficiency is improved.

In a preferred embodiment of the present disclosure, as shown in FIGS. 22 to 26, the left-hand drive light incident part 101, the left-hand drive transmission part 102, the right-hand drive light incident part 201 and the right-hand drive transmission part 202 are integrally formed and are of a transparent structure, the thickness of the left-hand drive cut-off part 103 and the right-hand drive cut-off part 203 is greater than or equal to 0.5 mm. At this time, the left-hand drive light incident part 101, the left-hand drive transmission part 102, the right-hand drive light incident part 201 and the right-hand drive transmission part 202 are integrally formed, and do not need to be separately assembled, and thus the whole optical device is convenient to assemble and high in structure stability. The thickness of the left-hand drive cut-off part 103 and the right-hand drive cut-off part 203 is greater than or equal to 0.5 mm, the requirements of the angle of the light patterns can be met, and the accuracy requirements of the manufacturing process can also be met.

Furthermore, as shown in FIGS. 23 to 26, the left-hand drive transmission part 102 and the right-hand drive transmission part 202 are both of a hollow closed structure, the light emergent end of the left-hand drive light incident part 101 is located in the hollow closed structure of the left-hand drive transmission part 102, the light emergent end of the right-hand drive light incident part 201 is located in the hollow closed structure of the right-hand drive transmission part 202, and the joint between the left-hand drive transmission part 102 and the right-hand drive transmission part 202 forms a narrow-end-up wedge-shaped cavity 3 with openings at the upper end and the lower end, wherein the left-hand drive cut-off part diagonal section 1033, the left-hand drive cut-off part turning point section 1032, the right-hand drive cut-off part diagonal section 2033 and the right-hand drive cut-off part turning point section 2032 are arranged at the light emergent end of the wedge-shaped cavity 3. Based on the integral formation of the left-hand drive transmission part 102 and the right-hand drive transmission part 202, light can be transmitted in the closed transmission parts through the structure, the optical efficiency is advantageously improved, meanwhile, the left-hand drive light pattern and the right-hand drive light pattern are effectively separated by forming the wedge-shaped cavity 3, so that the left-hand drive transmission part 101 and the right-hand drive transmission part 202 are not integrated. The left-hand drive cut-off part diagonal section 1033, the left-hand drive cut-off part turning point section 1032, the right-hand drive cut-off part diagonal section 2033 and the right-hand drive cut-off part turning point section 2032 are arranged at the light emergent end of the wedge-shaped cavity 3 and are located behind the horizontal light emergent ends of the left-hand drive transmission part 102 and the right-hand drive transmission part 202 by a certain distance, so that the left-hand drive transmission part 102 and the right-hand drive transmission part 202 are higher in structural strength after being integrally formed.

From the above description, it can be concluded that the optical device for the headlight of the present disclosure has the advantage that the left-hand drive light pattern and the right-hand drive light pattern are switched by independently turning on or off the light sources in the left-hand drive light incident part 101 and the right-hand drive light incident part 201, and in a specific light pattern situation, the light source corresponding to the unnecessary light pattern part is turned off, the corresponding light patterns do not need to be formed by shielding the light emitted by the light sources through a light-shielding structure, so that the optical efficiency is improved, meanwhile, the left-hand drive optical element 1 and the right-hand drive optical element 2 are each provided with the light incident part and the transmission part, so that more light emitted by the light sources is collected and collimated by the light incident parts, after the light is transmitted in the transmission parts, the headlight patterns with cut-off lines are formed due to the cutting-off effect of the cut-off parts, and thus the light utilization efficiency is higher; meanwhile, the device is simple in structure, and complicated structures such as a light-shielding sheet, a rotating mechanism and a solenoid valve are not required, so that an optical system is simple and easy to install; and the left-hand drive light pattern and the right-hand drive light pattern are switched by independently turning on or off the light sources in the left-hand drive light incident part 101 and the right-hand drive light incident part 201, mechanism noise of the rotating mechanism and the solenoid valve is avoided, and noiseless switching can be achieved.

On the basis of the above-mentioned optical device for the headlight according to the present disclosure, the second aspect of the present disclosure provides an automotive lighting device comprising a lens and the above-mentioned optical device. The left-hand drive light incident part 101 is provided with a left-hand drive light source correspondingly, and the right-hand drive light incident part 201 is provided with a right-hand drive light source correspondingly.

Further, the left-hand drive light incident part 101 is internally provided with the left-hand drive light source, and the right-hand drive light incident part 201 is internally provided with the right-hand drive light source 4. The left-hand drive light source and the right-hand drive light source 4 are independently arranged and are individually addressable so as to be independently turned on and off. When the left-hand drive light source is turned on and the right-hand drive light source 4 is turned off, light irradiation during left-hand driving is achieved, and when the right-hand drive light source 4 is turned on and the left-hand drive light source is turned off, light irradiation during right-hand driving is achieved. The lens is conventionally arranged as a secondary optical element of an automotive lighting device. The light emergent surface of the left-hand drive light source faces the left-hand drive light incident part 101, and the light emergent surface of the right-hand drive light source 4 faces the right-hand drive light incident part 201, wherein the light source may be one or more LED light sources or laser light sources. Further, the left-hand drive cut-off part 103 and the right-hand drive cut-off part 203 are located in the focal region of the lens, and the cut-off parts are not strictly limited to be located on the focal point of the lens here and may be slightly off, those skilled in the art can adjust according to different design situations, and the situation that the cut-off parts are located on the focus is not excluded. Those skilled in the art can clearly understand that the structure for forming a cut-off line is arranged at a position coincident with the focal point of the lens.

Figure 27:
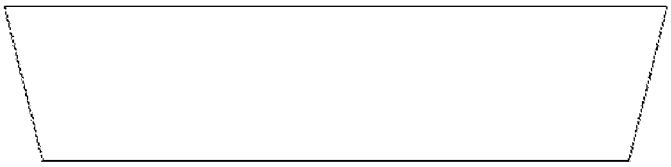
FIG. 27 is a schematic diagram of an auxiliary low-beam light pattern.
Figure 28:
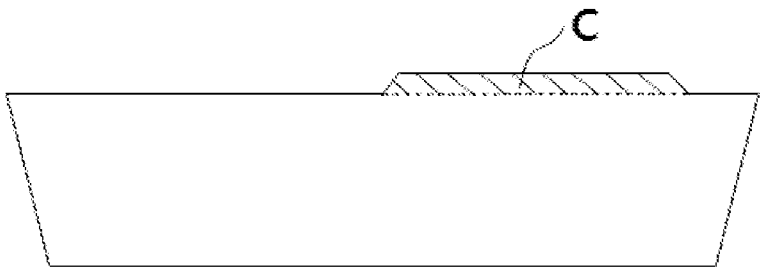
FIG. 28 is a schematic diagram of a light pattern formed by superimposing a left-hand drive cut-off part light pattern and an auxiliary low-beam light pattern according to the present disclosure.
Figure 29:
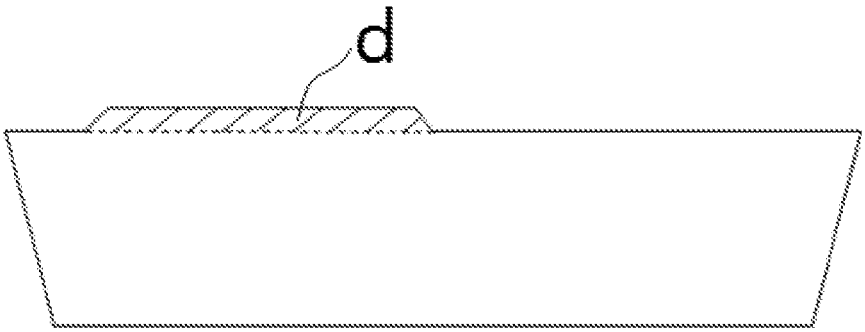
FIG. 29 is a schematic diagram of a light pattern formed by superimposing a right-hand drive cut-off part light pattern and an auxiliary low-beam light pattern according to the present disclosure.

According to the present disclosure, the automotive lighting device may further be provided with an auxiliary low-beam structure, and FIG. 27 shows a schematic diagram of an auxiliary low-beam light pattern, and a complete low-beam light pattern is formed after the auxiliary low-beam light pattern is superimposed on the cut-off part light pattern. FIG. 28 shows a schematic diagram of a light pattern formed by superimposing a light pattern of the left-hand drive cut-off part 103 and the auxiliary low-beam light pattern, wherein the c marker is "LHD Cutoff", which is the schematic diagram of a light pattern of the left-hand drive low-beam cut-off part, and the part of the light pattern is formed through the corresponding left-hand drive optical element 1 of the present disclosure. FIG. 29 is a schematic diagram of a light pattern formed by superimposing a light pattern of the right-hand drive cut-off part 203 and the auxiliary low-beam light pattern, wherein the d marker is "RHD Cutoff", which is the schematic diagram of a light pattern of the right-hand drive low-beam cut-off part, and the part of the light pattern is formed through the corresponding right-hand drive optical element 2 of the present disclosure. Auxiliary low-beam optical elements are not limited, the auxiliary low-beam can be implemented through the prior art and can be arranged in the same automotive lighting device with the optical device of the present disclosure, or can be arranged separately. The auxiliary low-beam and the light pattern formed by the left-hand drive optical element 1 or the right-hand drive optical element 2 may be superimposed with a certain fusion region or may be connected and superposed at the boundary.

On the basis of the above-mentioned automotive lighting device of the present disclosure, a third aspect of the present disclosure provides an automobile including the above-mentioned automotive lighting device, and therefore has at least all the beneficial effects brought by the technical solutions of the embodiments of the optical device for the headlight, which are not repeated here.

The preferred embodiments of the present disclosure have been described in detail above with reference to the accompanying drawings, but the present disclosure is not limited thereto. Within the scope of the technical idea of the present disclosure, various simple modifications can be made to the technical solutions of the present disclosure, including the combination of various specific technical characteristics in any suitable manner. In order to avoid unnecessary repetition, various possible combinations are not described separately in the present disclosure. However, these simple modifications and combinations should also be regarded as the content disclosed by the present disclosure and all belong to the protection scope of the present disclosure.

The invention claimed is:

1. An optical device for a headlight, comprising a left-hand drive optical element and a right-hand drive optical element, wherein the left-hand drive optical element comprises a left-hand drive light incident part and a left-hand drive transmission part which is arranged in a light emergent end region of the left-hand drive light incident part and extends in a light emergent direction, and the light emergent end of the left-hand drive transmission part is provided with a left-hand drive cut-off part capable of forming a left-hand drive cut-off line; and the right-hand drive optical element comprises a right-hand drive light incident part and a right-hand drive transmission part which is arranged in a light emergent end region of the right-hand drive light incident part and extends in the light emergent direction, and the light emergent end of the right-hand drive transmission part is provided with a right-hand drive cut-off part capable of forming a right-hand drive cut-off line;

the left-hand drive cut-off part comprises a left-hand drive cut-off part horizontal line section, a left-hand drive cut-off part turning point section and a left-hand drive cut-off part diagonal section, and the right-hand drive cut-off part comprises a right-hand drive cut-off part horizontal line section, a right-hand drive cut-off part turning point section and a right-hand drive cut-off part diagonal section;

the left-hand drive light incident part, the left-hand drive transmission part, the right-hand drive light incident part and the right-hand drive transmission part are integrally formed and are of a transparent structure, and the thickness of the left-hand drive cut-off part and the right-hand drive cut-off part is greater than or equal to 0.5 mm.

2. An automotive lighting device, comprising a lens and the optical device according to claim 1, the left-hand drive light incident part is provided with a left-hand drive light source correspondingly, and the right-hand drive light incident part is provided with a right-hand drive light source correspondingly.

3. The automotive lighting device according to claim 2, wherein the left-hand drive light incident part is internally provided with the left-hand drive light source, and the right-hand drive light incident part is internally provided with the right-hand drive light source.

4. The automotive lighting device according to claim 2, wherein the left-hand drive light source and the right-hand drive light source are independently arranged and are individually addressable so as to be independently turned on and off.

5. The automotive lighting device according to claim 2, wherein the left-hand drive light source and the right-hand drive light source are each composed of one or more LED light sources or laser light sources.

6. The automotive lighting device according to any one of claims 2 to 5, wherein the left-hand drive cut-off part and the right-hand drive cut-off part are located in the focal region of the lens.

7. An automobile, comprising the automotive lighting device according to claim 2.

8. The optical device for the headlight according to claim 1, wherein the left-hand drive light incident part and the right-hand drive light incident part each comprise a light source connection portion and a lampshade, each light source connection portion is a concave arc surface cavity, and each lampshade is a horn-shaped light condensing cup which is gradually enlarged from an end close to the corresponding light source to an end away from the corresponding light source.

9. The optical device for the headlight according to claim 1, wherein the left-hand drive cut-off part horizontal line section and the right-hand drive cut-off part horizontal line section are of a horizontal concave structure.

10. The optical device for the headlight according to claim 1, wherein the left-hand drive transmission part and the right-hand drive transmission part are both of a hollow closed structure, the light emergent end of the left-hand drive light incident part is located in the hollow closed structure of the left-hand drive transmission part, the light emergent end of the right-hand drive light incident part is located in the hollow closed structure of the right-hand drive transmission part, and the joint between the left-hand drive transmission part and the right-hand drive transmission part forms a narrow-end-up wedge-shaped cavity with openings at the upper end and the lower end;

wherein, the left-hand drive cut-off part diagonal section, the left-hand drive cut-off part turning point section, the right-hand drive cut-off part diagonal section and the right-hand drive cut-off part turning point section are arranged at the light emergent end of the wedge-shaped cavity.

11. An optical device for a headlight, comprising a left-hand drive optical element and a right-hand drive optical element, wherein the left-hand drive optical element comprises a left-hand drive light incident part and a left-hand drive transmission part which is arranged in a light emergent end region of the left-hand drive light incident part and extends in a light emergent direction, and the light emergent end of the left-hand drive transmission part is provided with a left-hand drive cut-off part capable of forming a left-hand drive cut-off line; and the right-hand drive optical element comprises a right-hand drive light incident part and a right-hand drive transmission part which is arranged in a light emergent end region of the right-hand drive light incident part and extends in the light emergent direction, and the light emergent end of the right-hand drive transmission part is provided with a right-hand drive cut-off part capable of forming a right-hand drive cut-off line;

the left-hand drive light incident part and the left-hand drive transmission part are integrally formed and are of a transparent structure, the right-hand drive light incident part and the right-hand drive transmission part are integrally formed and are of a transparent structure; and the left-hand drive transmission part and the right-hand drive transmission part are independently arranged; and the thickness of the left-hand drive cut-off part and the right-hand drive cut-off part is greater than or equal to 0.5 mm.

12. An automotive lighting device, comprising a lens and the optical device according to claim 11, the left-hand drive light incident part is provided with a left-hand drive light source correspondingly, and the right-hand drive light incident part is provided with a right-hand drive light source correspondingly.

13. The automotive lighting device according to claim 12, wherein the left-hand drive light source and the right-hand drive light source are each composed of one or more LED light sources or laser light sources.

14. The automotive lighting device according to claim 12, wherein the left-hand drive light source and the right-hand drive light source are independently arranged and are individually addressable so as to be independently turned on and off.

15. The automotive lighting device according to claim 12, wherein the left-hand drive light incident part is internally provided with the left-hand drive light source, and the right-hand drive light incident part is internally provided with the right-hand drive light source.

16. The automotive lighting device according to any one of claims 12 to 15, wherein the left-hand drive cut-off part and the right-hand drive cut-off part are located in the focal region of the lens.

17. An automobile, comprising the automotive lighting device according to claim 12.

18. The optical device for the headlight according to claim 11, wherein the left-hand drive cut-off part comprises a left-hand drive cut-off part horizontal line section, a left-hand drive cut-off part turning point section and a left-hand drive cut-off part diagonal section, and the right-hand drive cut-off part comprises a right-hand drive cut-off part horizontal line section, a right-hand drive cut-off part turning point section and a right-hand drive cut-off part diagonal section.

19. The optical device for the headlight according to claim 18, wherein the left-hand drive cut-off part horizontal line section and the right-hand drive cut-off part horizontal line section are of a horizontal concave structure.

20. The optical device for the headlight according to claim 11, wherein the left-hand drive light incident part and the right-hand drive light incident part each comprise a light source connection portion and a lampshade, each light source connection portion is a concave arc surface cavity, and each lampshade is a horn-shaped light condensing cup which is gradually enlarged from an end close to the corresponding light source to an end away from the corresponding light source.

21. The optical device for the headlight according to claim 11, wherein the left-hand drive transmission part and the right-hand drive transmission part are both of a hollow closed structure, the light emergent end of the left-hand drive light incident part is located in the hollow closed structure of the left-hand drive transmission part, and the light emergent end of the right-hand drive light incident part is located in the hollow closed structure of the right-hand drive transmission part.

22. An optical device for a headlight, comprising a left-hand drive optical element and a right-hand drive optical element, wherein the left-hand drive optical element comprises a left-hand drive light incident part and a left-hand drive transmission part which is arranged in a light emergent end region of the left-hand drive light incident part and extends in a light emergent direction, and the light emergent end of the left-hand drive transmission part is provided with a left-hand drive cut-off part capable of forming a left-hand drive cut-off line; and the right-hand drive optical element comprises a right-hand drive light incident part and a right-hand drive transmission part which is arranged in a light emergent end region of the right-hand drive light incident part and extends in the light emergent direction, and the light emergent end of the right-hand drive transmission part is provided with a right-hand drive cut-off part capable of forming a right-hand drive cut-off line;

the left-hand drive cut-off part comprises a left-hand drive cut-off part horizontal line section, a left-hand drive cut-off part turning point section and a left-hand drive cut-off part diagonal section, and the right-hand drive cut-off part comprises a right-hand drive cut-off part horizontal line section, a right-hand drive cut-off part turning point section and a right-hand drive cut-off part diagonal section;

the left-hand drive light incident part and the left-hand drive transmission part are independently arranged, and the right-hand drive light incident part and the right-hand drive transmission part are independently arranged, and the left-hand drive transmission part, the left-hand drive cut-off part, the right-hand drive transmission part and the right-hand drive cut-off part are integrally formed and are of a plate structure with the thickness being less than or equal to 2 mm;

wherein, the left-hand drive cut-off part diagonal section intersects with the right-hand drive cut-off part diagonal section, and the distance between the left-hand drive cut-off part turning point section and the right-hand drive cut-off part turning point section is less than or equal to 2 mm.

23. An automotive lighting device, comprising a lens and the optical device according to claim 22, the left-hand drive light incident part is provided with a left-hand drive light source correspondingly, and the right-hand drive light incident part is provided with a right-hand drive light source correspondingly.

24. The automotive lighting device according to claim 23, wherein the left-hand drive light incident part is internally provided with the left-hand drive light source, and the right-hand drive light incident part is internally provided with the right-hand drive light source.

25. The automotive lighting device according to claim 23, wherein the left-hand drive light source and the right-hand drive light source are independently arranged and are individually addressable so as to be independently turned on and off.

26. The automotive lighting device according to claim 23, wherein the left-hand drive light source and the right-hand drive light source are each composed of one or more LED light sources or laser light sources.

27. The automotive lighting device according to any one of claims 23 to 26, wherein the left-hand drive cut-off part and the right-hand drive cut-off part are located in the focal region of the lens.

28. An automobile, comprising the automotive lighting device according to claim 23.

29. The optical device for the headlight according to claim 22, wherein the left-hand drive light incident part and the right-hand drive light incident part each comprise a light source connection portion and a lampshade, each light source connection portion is a concave arc surface cavity, and each lampshade is a horn-shaped light condensing cup which is gradually enlarged from an end close to the corresponding light source to an end away from the corresponding light source.

30. The optical device for the headlight according to claim 22, wherein the left-hand drive cut-off part horizontal line section and the right-hand drive cut-off part horizontal line section are of a horizontal concave structure.

31. The optical device for the headlight according to claim 22, wherein the upper surfaces of the left-hand drive transmission part and the right-hand drive transmission part are provided with aluminum plating layers, and the reflectivity of the aluminum plating layers is greater than or equal to 0.8.

* * * * *